United States Patent [19]

Wepfer

[11] Patent Number: 4,665,866

[45] Date of Patent: May 19, 1987

[54] GRID-TYPE FLOW DISTRIBUTION BAFFLE

[75] Inventor: Robert M. Wepfer, Export, Pa.

[73] Assignee: Westinghouse Electric Corp., Pittsburgh, Pa.

[21] Appl. No.: 772,583

[22] Filed: Sep. 4, 1985

[51] Int. Cl.[4] ..... F22B 37/24

[52] U.S. Cl. ..... 122/510; 122/32; 122/235 F; 122/493; 165/159; 165/162; 376/389; 376/462

[58] Field of Search ..... 122/33, 32, 235 F, 510, 122/511, 512, 493; 165/162, 159; 376/462, 377, 389, 399

[56] References Cited

U.S. PATENT DOCUMENTS

| | | | |
|---|---|---|---|
| Re. 28,362 | 3/1975 | Calvin | 376/ |
| 3,439,737 | 4/1969 | Boorman et al. | 165/162 |
| 3,764,470 | 10/1973 | Calvin | 376/ |
| 3,809,609 | 5/1974 | Krawiec et al. | 376/ |
| 3,811,498 | 5/1974 | Ferraro et al. | 122/32 X |
| 3,841,272 | 10/1974 | Mayer et al. | 122/32 |
| 3,847,736 | 11/1974 | Bevilacqua | 376/ |
| 3,867,908 | 2/1975 | Byerley et al. | 165/159 X |
| 4,090,918 | 5/1978 | Masetti | 165/162 X |
| 4,120,350 | 10/1978 | Norton | 122/510 X |
| 4,125,434 | 11/1978 | Fromel et al. | 376/ |
| 4,337,827 | 7/1982 | Jabsen | 122/510 X |
| 4,344,480 | 8/1982 | Boyer et al. | 165/162 |
| 4,384,697 | 5/1983 | Ruhe | 165/162 X |

FOREIGN PATENT DOCUMENTS

| | | | |
|---|---|---|---|
| 78208 | 5/1983 | European Pat. Off. | 122/493 |
| 47993 | 3/1983 | Japan | 165/162 |

OTHER PUBLICATIONS

Application Ser. No. 695,036 filed Jan. 25, 1985 by Robert M. Wepfer, entitled "Baffle Plate with Eight-Lobed Tube-Receiving Openings and Cold-Formed Flow-Resisting Tabs in Each Lobe".

Application Ser. No. 670,773 filed Nov. 13, 1984 by R. M. Wilson et al, entitled "Steam Generator Tube Support".

*Primary Examiner*—Albert J. Makay
*Assistant Examiner*—Steven E. Warner
*Attorney, Agent, or Firm*—L. A. DePaul

[57] ABSTRACT

An improved, grid-type flow distribution baffle for both providing lateral support for an array of heat exchange tubes and for generating a sludge-sweeping water current within a steam generator is disclosed herein. Generally, the improved baffle comprises a plurality of grid members for defining an array of square, tube-capturing cells, wherein each wall of the cell is closely adjacent and contactable with the side of the tube. Each of the cells is circumscribed by a flange at one of its ends which includes a substantially circular opening for allowing the tube to extend through the cell. The flange includes four flat portions spaced 90° apart for rendering the flange flush with the center portion of each of the square walls which form the cells of the baffle. These flat portions allow the flange to closely circumscribe the tube without coming into contact with it, thereby avoiding "point contact" between the flange and the tube. The improved baffle finds particular use when mounted over the tubesheet of a nuclear steam generator. The flanges which closely circumscribe each of the tubes create enough current-diverting fluid resistance within the baffle so that a relatively rapid, sludge-sweeping radial flow of water is directed over the tubesheet. However, a sufficient amount of space is left between the flanges and their respective tubes so that a sufficient amount of water flows through these cells to prevent localized boiling from occurring therein.

22 Claims, 9 Drawing Figures

FIG 1
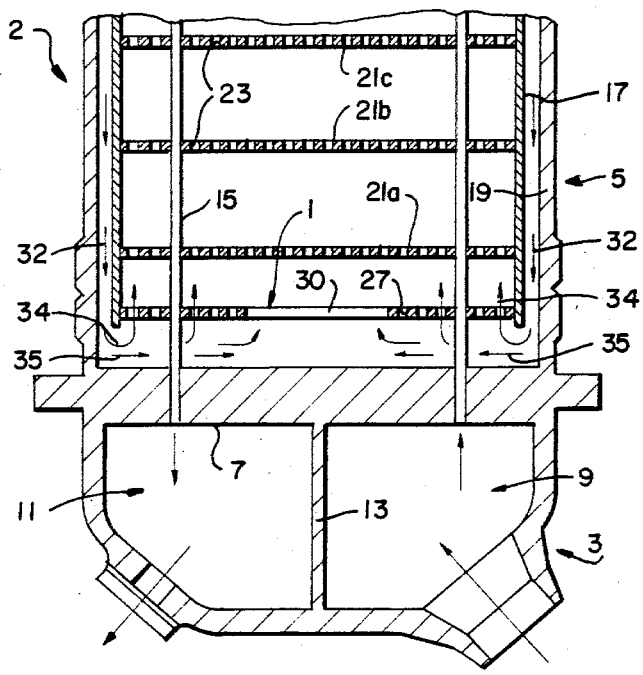
FIG 2
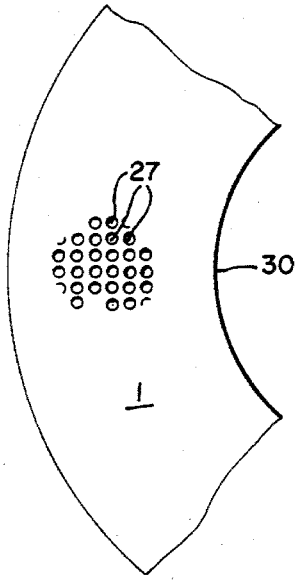
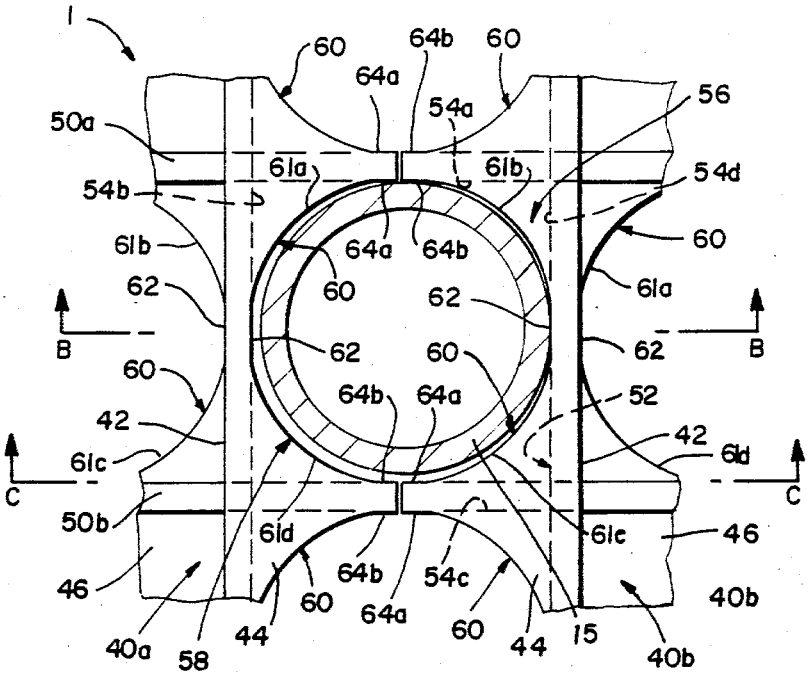
FIG 3A

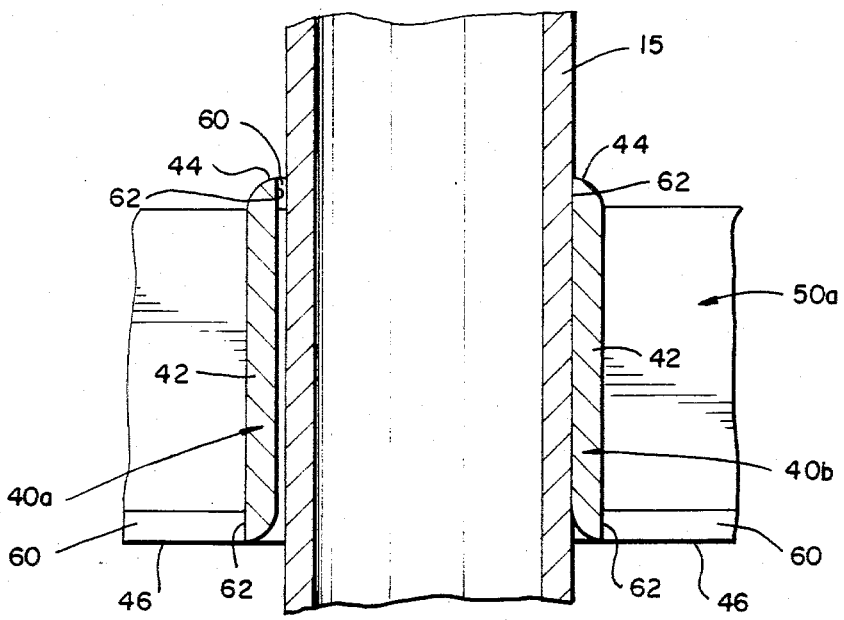
FIG 3B
FIG 3C
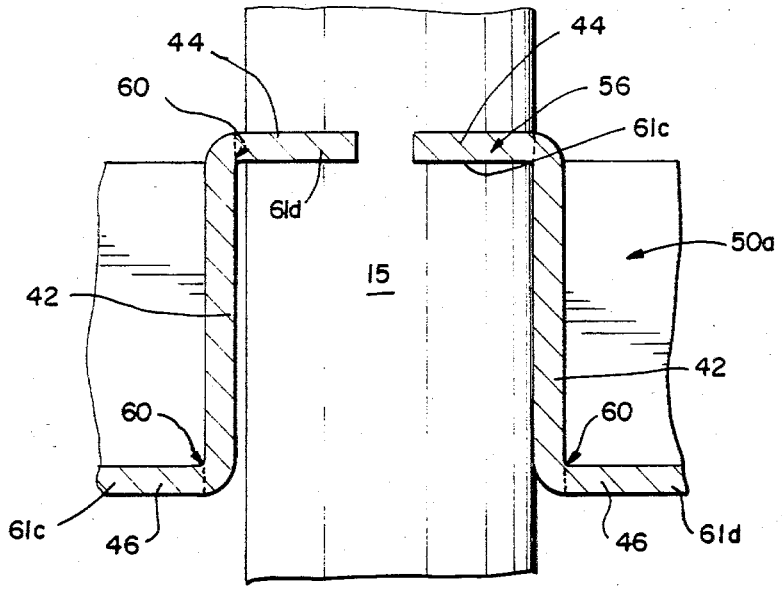

GRID-TYPE FLOW DISTRIBUTION BAFFLE

BACKGROUND OF THE INVENTION

1. Field of the Invention

This invention relates to a grid-type flow distribution baffle for use within a steam generator having an array of heat exchange tubes. The baffle provides lateral support for the tubes, and helps to generate a sludge-sweeping, radially-oriented flow of water over the tubesheet of the generator.

2. Description of the Prior Art

Flow distribution baffle plates are known in the prior art. Generally, such baffle plates are mounted about 20 inches above the tubesheet in the secondary side of a nuclear steam generator, and include an array of bores for receiving the numerous U-shaped heat exchange tubes present in the secondary side of the generator. Such baffle plates are circular in shape, and are mounted around the lower edge of the cylindrical tube wrapper which encloses the U-shaped tubes. A large, centrally disposed opening is disposed in the center of such plates for providing a flow path for the water which flows between the upper surface of the tubesheet and the lower surface of the baffle plate. These baffle plates perform two important functions. First, the tube-receiving bores lend lateral support to the relatively long and flexible U-shaped heat exchange tubes present in the secondary side of the steam generator. Second, these plates divert a substantial portion of the vertically oriented flow of secondary water into a radially oriented flow across the tubesheet of the nuclear steam generator, which in turn entrains (or "sweeps") and removes the particulate matter or sludges which would otherwise accumulate on top of the tubesheet. This second function is important, because even though the U-shaped tubes are formed from corrosion- resistant Inconel®, the corrodants which can become concentrated in such sludges can eventually lead to stress-corrosion cracking of the U-shaped tubes if they are allowed to accumulate on top of the tubesheet.

One of the primary problems associated with prior art baffle plates has been the design of a tube-receiving bore or opening in the plate which provides a sufficient amount of current-diverting flow resistance while preventing crevice boiling from occurring within the plate. Crevice boiling occurs whenever the amount of water flowing in the annular space between the tube and the plate opening falls below a certain minimum. Under such conditions, the relatively hot heat exchange tube boils water away from a particular section of this annular space faster than the surrounding flow of water can reimmerse this region. Such localized crevice boiling concentrates sludges, and hence corrodants, in the annular space between the tube and the opening in the plate, which can accumulate and corrode and ultimately crack the wall of the tube. If the wall of the tube becomes cracked, radioactive water from the primary side of the steam generator will contaminate the non-radioactive water in the secondary side of the generator.

One of the first of these prior art baffle plate designs employed a cylindrically shaped, tube-receiving bore in which the annular clearance between the bores and the tubes was small enough so that most of the vertically oriented water currents flowing upwardly from the tubesheet would not flow through the baffle plate, but would instead be diverted into a radially-oriented flow which travelled between the underside of the baffle and the top surface of the tubesheet. Additionally, the annular clearance between the bore and the tube was large enough so that when the tube was concentrically disposed in its respective bore, a sufficient amount of water flowed in the annular space therebetween to prevent crevice boiling. Despite the intent of this design, a substantial amount of crevice boiling occurred in the annular spaces between the tubes and the bores in the plate due to the fact that the tubes usually extended through their respective bores in an off-center manner. This, in turn, allowed only a very thin film of water to flow between the tube and the cylindrical bore in the region where the tube came into contact with the bore. Because this thin film of flowing water could not absorb the heat transferred by the tube without vaporizing, crevice boiling occurred.

In a later design, the cylindrical bores were replaced with apertures having an octagonal profile. While the octagonal shape of the tube-receiving openings allowed a greater flow of water to occur in the region where the tube was closest to the walls of the openings, some crevice boiling still occurred.

In one of the latest prior art designs (the "mini-broach quatrefoil"), a generally circular bore having four flat lands spaced 90° from one another is used. Such a design goes further in eliminating crevice boiling, since it allows an even greater amount of water to occur between the tube and its aperture in the region where the tube is closest thereto. But some crevice boiling can still occur in the regions where the flat lands come into close contact with the outer walls of the tube. Hence, no plate-type baffle has yet been developed which is satisfactory in all respects.

Grid-type flow distribution baffles formed from an interlocking network of metallic straps or bars are also known in the prior art. Grid-type baffles are relatively simple and inexpensive to manufacture, and are relatively easier to install. Additionally, little if any crevice boiling occurs between the cells formed by the grid bars and the heat exchange tubes captured within these cells, due to the large, water-conducting spaces between the bars forming the tube-capturing cells, and the tubes themselves. But these large current-conducting spaces also prevent such grid-type flow distribution baffles from effectively diverting the vertical flow of water in the secondary side of such steam generators into a sludge-sweeping radial flow. One solution to this problem might be to provide some sort of flange around the edges of the tube-capturing cells which would provide a sufficient amount of current-diverting, fluid resistance to each cell so that the baffle, as a whole, diverted most of the vertical current flow to a sludge-sweeping radial flow. However, such a flange would provide a situs for "point contact" to occur between the tube and the cell, which again would lead to poor wear performance.

Clearly, there is a need for a grid-type flow distribution baffle which is easy to manufacture, but which is capable of diverting the vertically oriented water currents within the secondary side of a steam generator into sludge-sweeping, radially oriented currents. Ideally, such a grid-type baffle should further provide lateral support for the relatively long and flexible U-shaped heat exchange tubes inside such generators without any regions of "point contact" between the outer wall of the tube and the inner walls of the grid cells.

SUMMARY OF THE INVENTION

In its broadest sense, the invention is an improved, grid-type flow distribution baffle for both supporting an array of heat exchange tubes inside a heat exchanger, and for diverting a flow of heat-exchanging fluid from a parallel to a transverse direction with respect to the orientation of the tubes. The improved baffle generally comprises a plurality of grid members which provide an array of tube-capturing, flat walled cells, each of which has between three and seven flat sides arranged in the shape of a regular polygon. Each of the walls of the cells is closely adjacent and contactable with the outer surface of its respective tube. The improved baffle further comprises a fluid flow resisting means connected around one of the edges of each cell which at least partially circumscribes the tube in the cell, but does not come into contact with it. The provision of such a fluid flow resisting means effectively diverts the flow of heat-exchanging fluid from a parallel to a transverse direction with respect to the longitudinal axis of the tube while allowing a maximum amount of heat-exchanging fluid to flow around the tube. When used in a steam generator, the improved flow distribution baffle is capable of diverting a substantial amount of the vertically oriented flow of secondary water in the vicinity of the tubesheet to a relatively rapid, radially oriented sludge-sweeping flow over this tubesheet, while preventing crevice boiling from occurring within the tube-capturing cells.

In the preferred embodiment, the fluid flow resisting means is a flange which completely circumscribes the tube, but which is incapable of coming into contact with it. The flange of each of the multi-walled cells of the baffle is preferably generally circular in shape, and includes a plurality of flat sections for placing the flange in a flush relationship with each of the walls of its respective cell. For example, if the cell has four walls arranged in the shape of a square, the generally circular flange includes four flat sections spaced 90° apart from one another for placing the flange in a flush relationship along the center portions of each of the four walls of the cell. A tube disposed through such a cell may come into "line contact" with any two adjacent walls of the square cell, but cannot come into contact with the circular flange at all. Consequently, "point contact" is avoided between the tube and the cell, which in turn minimizes the chances for tube denting or high wear rates.

The array of tube-capturing cells may be formed from a parallel set of "Z" shaped bars, each of which includes a central flat strip portion and upper and lower flanges which point in opposite directions. Both the upper and lower flanges may include a plurality of semicircular recesses for defining circular flanges when two of the "Z" shaped bars are interlocked in confronting relationship. Further, the central flat strip portions of each of the "Z" shaped bars may include a plurality of equidistantly spaced slots for receiving a series of parallel and equidistantly spaced flat locking bars which not only lock the "Z" shaped bars together, but which also define two of the four walls of each of the square, tube-capturing cells. In an alternative embodiment, the improved baffle plate may be formed from a plurality of "T" or modified "T" shaped bars, each of which includes an array of mutually registrable arcuate slots for forming tube-surrounding, non-contacting flanges.

BRIEF DESCRIPTION OF THE SEVERAL FIGURES

FIG. 1 is a cross-sectional side view of the bottom half of a nuclear steam generator;

FIG. 2 is a partial plan view of the flow distribution baffle disposed within this steam generator;

FIG. 3A is a plan view of the flow distribution baffle of the invention, shown with only one of the many U-shaped heat exchange tubes which extend therethrough;

FIG. 3B is a cross-sectional side view of the flow distribution baffle of FIG. 3A, taken along line B—B;

FIG. 3C is a cross-sectional side view of the flow distribution baffle of FIG. 3A, taken along line C—C;

DETAILED DESCRIPTION OF THE PREFERRED EMBODIMENT

Figure 3D:
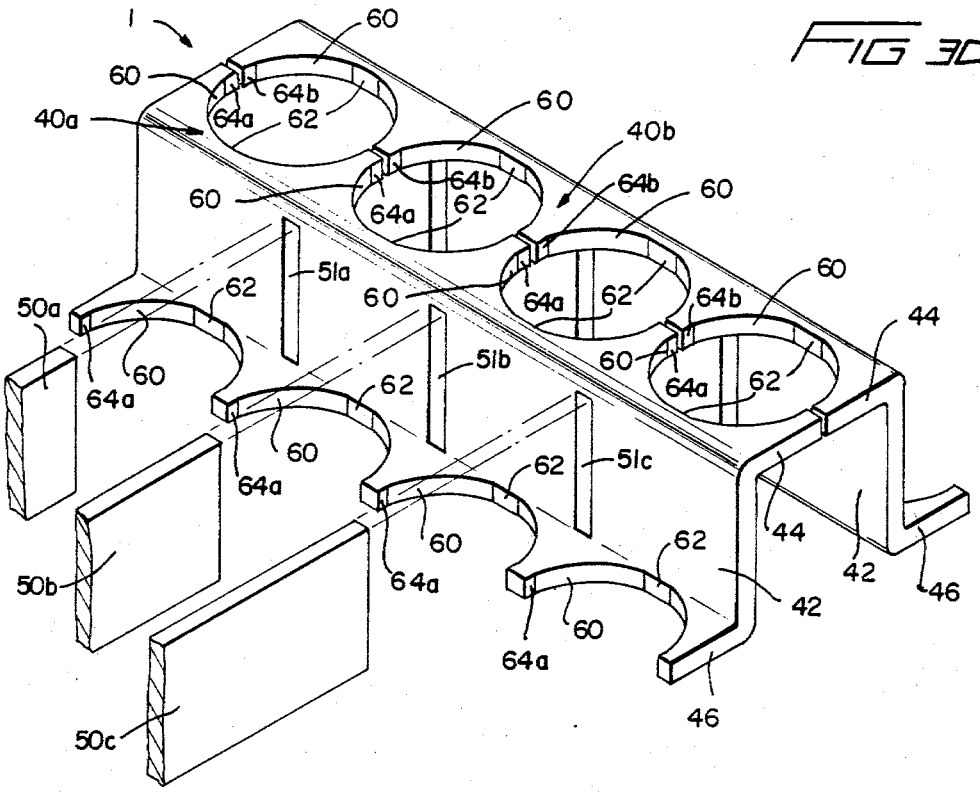
FIG. 3D is a perspective, exploded view of the flow distribution baffle of FIG. 3A.

General Overview of the Environment, Structure and Function of the Invention With reference now to FIGS. 1 and 2, the grid-type flow distribution baffle 1 of the invention is particularly useful in providing both tube support and a sludge-sweeping flow of water within a nuclear steam generator 2. Such generators 2 generally include a primary side 3 and a secondary side 5 which are hydraulically isolated from one another by means of a tubesheet 7. The primary side 3 in turn includes an inlet section 9 and an outlet section 11 which are hydraulically isolated from one another by means of the centrally disposed divider plate 13. A plurality of U-shaped heat exchange tubes 15 (only one of which is shown) are mounted within the tubesheet 7 as indicated. Hot, radioactive water from the reactor core enters the inlet section 9 of the primary side 3 and flows into the open ends of the U-shaped tubes 15 (as indicated by flow arrows). This water travels completely around the U-bend of the tubes (not shown) and out into the outlet section 11 of the primary side 3, where it is ultimately recycled back into the reactor core. In the meantime, non-radioactive water is circulated over the outside surfaces of the U-shaped tubes 15 in the secondary side 5 of the generator 2 in order to produce steam which is ultimately used to spin the turbines of electric generators. This non-radioactive water enters a port (not shown) in the side wall of the secondary side 5, where it proceeds to flow downwardly in the annular space defined between the cylindrical tube bundle wrapper 17 and the inner wall of the secondary side 19. This "downcomer" flow 32 eventually impinges against the top of the outer edge of the tubesheet 7, where it is deflected into a vertical flow 34. However, because of the flow resistance imparted onto the vertical flow 34 by the flow distribution baffle 1, this vertical flow 34 is redirected into a radial flow 35 as indicated. This radial flow 35 is attracted to the central aperture 30 located in the center of the flow distribution baffle 1, where it again changes direction into a vertically oriented flow.

In addition to diverting the vertical flow 34 of water into a sludge-sweeping radial flow 35, the baffle plate 1 also provides lateral support for the relatively long and flexible U-shaped tubes 15. Specifically, baffle plate 1 includes an array of tube-receiving apertures 27 which are registrable with the legs of the U-shaped tubes 15. In order to provide further lateral support for these tubes 15, a plurality of tube support plates 21*a*–21*c* are also provided throughout the length of the secondary side 5 of the steam generator 2. Like the flow distribution baffle 1, each of these support plates 21*a*–21*c* includes an array of tube-receiving openings 23 through which the legs of the U-shaped tubes 15 are received.

The general structure and operation of the flow distribution baffle 1 may best be understood with reference to FIG. 3A. In each of the three embodiments of the invention illustrated in FIGS. 3A–3D, FIGS. 4A and 4B, and FIG. 5, the various grid member form an array of square, tube-capturing cells 52 whose walls 54*a*–54*d* are closely adjacent and parallel with the outer walls of the tube 15. The tube 15 is contactable with each of these walls 52*a*–54*d* throughout the entire length of the wall, although the slightly off-center tube 15 will typically only contact two of the four walls, as illustrated in FIG. 3A. Such "line contact" between the tube 15 and the walls 54*a*–54*d* is far more desirable than "point contact" or knife-edge contact between these two components, since any "point contact" between the walls 54*a*–54*d* and the tube 15 could generate a situs of tube wear.

Disposed around the top edge of the square, tube-capturing cell 52 is a flow-resisting flange 56 which forms a generally circular opening 58. The flange 56 resists enough of the vertical flow of water which would ordinarily travel through the corners of the tube-capturing cell 52 to create the desired, sludge-sweeping radial flow, but admits enough of this vertical flow to prevent crevice boiling from occurring between the cell 52 and the tube 15.

In order to insure that the flange 56 does not come into contact with the outer surface of the tube 15 and create points of localized stress thereon, the flange 56 is provided with four equidistantly spaced flat portions 62 and 64*a*, 64b which render the flange 56 flush with the central portions of each of the walls 54*a*–54*d*. In the preferred embodiment, each of the flat portions 62 and 64*a*, 64*b* is approximately 20% of the maximum diameter of the circular opening 58. Because this configuration leaves an ample amount of flowing water between the outer surface of tube 15 and cell walls 52*a*–54*d*, and the flange 56, no crevice boiling can occur at any point between the cell 52 and the tube 15.

Specific Description of the Preferred Embodiments of the Invention

With reference now to FIGS. 3A, 3B and 3C, one preferred embodiment of the flow distribution baffle 1 of the invention is formed from pairs of opposing "Z" shaped bars 40*a*, 40*b*. Each of these bars 40*a*, 40*b* includes a central flat section 42, a rectangular top flange 44, and a rectangular bottom flange 46. As may best be seen with respect to FIG. 3*d*, these bars 40*a*, 40*b* are interlocked in the position shown by means of locking bars 50*a*–50*c* which are insertable within slots 51 provided in the central flat sections 42 of the bars 40*a*, 40*b*. When these bars 40*a*, 40*b* are assembled with the locking bars 50*a*–50*c*, an array of square, tube-capturing cells 52 is formed which is registrable with the array of vertically oriented heat exchange tubes 15 present in the secondary side 3 of the steam generator 2. Each of these tube-capturing cells 52 includes four walls 54*a*–54*d* which are parallel to the sides of the tube 15 as indicated. As may best be seen with respect to FIG. 3A, a flow-resisting annular flange 56 is disposed around the end of each of the square, tube-capturing cells 52. A generally circular opening 58 is present in each of these flanges 56. In this particular embodiment, the generally circular opening 58 is formed from the alignment of semicircular recesses 60 which are equidistantly spaced along both the top and bottom flanges 44 and 46 of each of the bars 40*a*, 40*b*. Each of these semicircular recesses 60 includes a proximal flat portion 62, and two distal flat portions 64*a*, 64*b* as shown. The length of the proximal flat portion 62 is approximately 20% of the maximum diameter of the circular opening 58, while the length of the distal flat portions 64*a*, 64*b* are approximately 10% of this diameter. Each of these flat portions 64*a*, 64*b* define a region where the flange 56 is flush with the walls 54*a*–54*d* of its respective cell 52. When the bars 40*a*, 40*b* are placed into confronting relationship as illustrated in FIG. 3A, the distal flat portions 64*a*, 64*b* located on the outer edges of each of the semicircular recesses 60 form a flat portion which, like the proximal flat portion 62, has a total length of approximately 20% of the maximum diameter of the flange 56.

In the preferred embodiment, the four arcs 61*a*–61*d* which make up the balance of the generally circular opening 58 have the same radius, but not the same origin. Accordingly, while the opening 58 generally appears to be circular, it may more accurately be thought of as a square with rounded corners. The end result of such a configuration is that the tube 15 can come into "line contact" with one or two of the walls 54*a*–54*d* of the square, tube-capturing cell 52, but cannot come into "point contact" with the edge of the flange 56. Additionally, the relatively large amounts of space between the tube 15 and the walls 54*a*–54*d* insure that a sufficient amount of heat-absorbing water will always flow around the tube 15 in these areas. This, in turn, eliminates (or at least minimizes) the possibility of crevice boiling occurring within the cell 52. Finally, the geometry of the arcs which form most of the generally circular opening 58 is such that a large enough gap exists between the outer surface of the tube 15 and the inner edge of the flange 56, so that no crevice boiling (and consequent sludge-forming dryout) will occur in the space between the tube 15 and the flange 56.

Figure 4A:
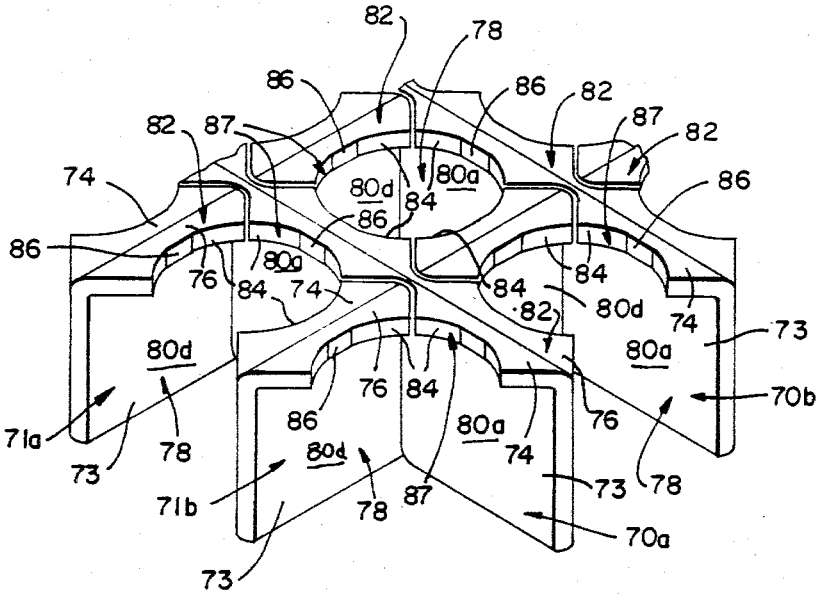
FIG. 4A is a perspective view of an alternative embodiment of the flow distribution baffle of the invention.
Figure 4B:
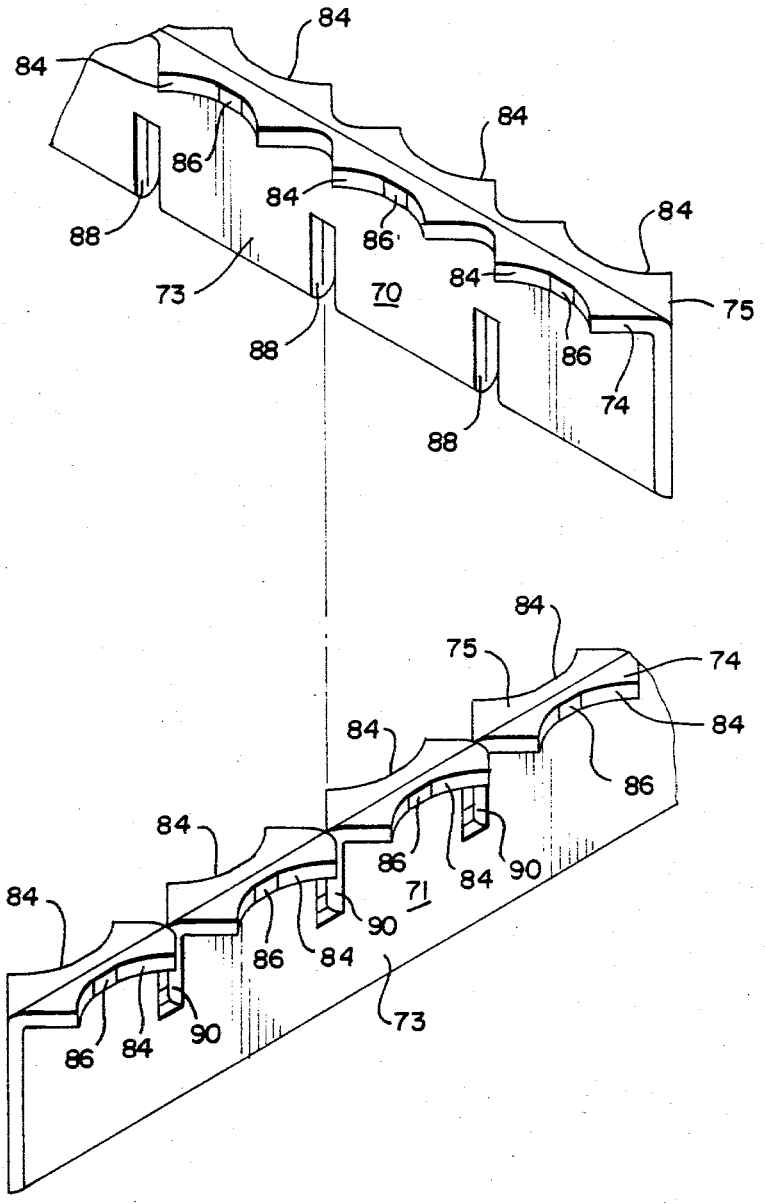
FIG. 4B is an exploded, perspective view of the flow distribution baffle illustrated in FIG. 4A.

FIGS. 4A and 4B illustrate an alternative embodiment of the invention, wherein upper and lower "T" shaped bars 70, 71 are interconnected to form an array of square, tube-capturing cells 78. Each of the "T" shaped bars 70, 71 includes a central flat section 73, and two opposing side flanges 74, 76. When the "T" shaped bars 70, 71 are assembled into the flow distribution baffle 1 illustrated in FIG. 4A, the central flat section 73 of the "T" shaped bars 70, 71 defines an array of square, tube-capturing cells 78 having four flat walls 80a-80d, each of which is parallel with the surface of the tube 15. Disposed around the upper edge of each of these square, tube-capturing cells 78 is a flow-resisting annular flange 82 formed from the quarter-circular recesses 84 which are present in, and equidistantly spaced along, the side flanges 74, 76 of both the upper and lower "T" shaped bars 70, 71. Each of these quarter-circular recesses 84 includes a flat portion 86, which again is approximately 20% of the maximum diameter of the generally circular opening 87 formed from four of the quarter-circular recesses 84. As may best be seen with reference to FIG. 4B, each of the upper "T" shaped bars 70 includes a plurality of slots 88 in its central flat section 73 which extends halfway up along its bottom edge. Similarly, each of the lower "T" shaped bars 71 includes a plurality of complementary slots 90 in its central flat section 73 which extends halfway down the central flat section 73 from its top edge. A flow distribution baffle 1 embodying the invention may be formed by interlocking the slots 88, 90 of a plurality of upper and lower "T" shaped bars 70, 71. The resulting square, tube-capturing cells 78 and current blocking annular flanges 82 function in precisely the same manner as described with respect to the embodiment illustrated in FIGS. 3A–3D.

Figure 5:
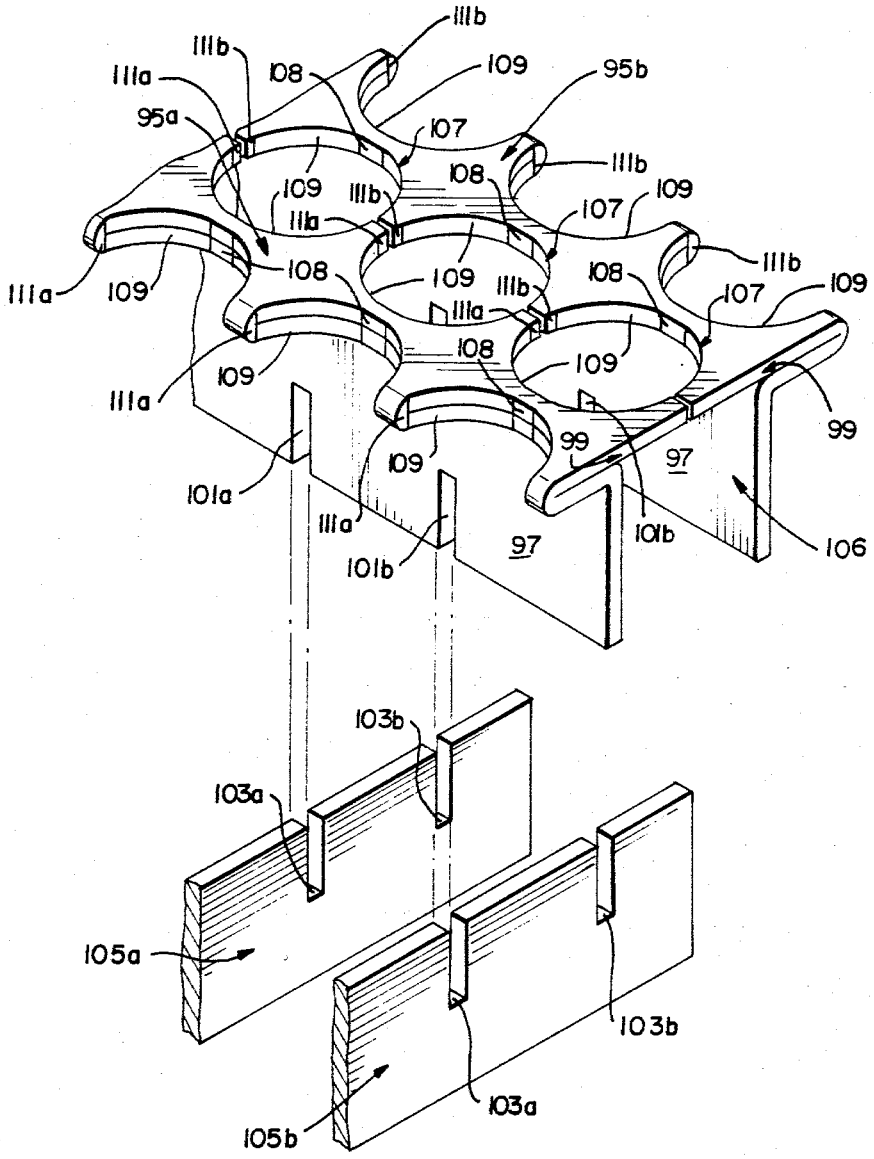
FIG. 5 is an exploded, perspective view of still another embodiment of the flow distribution baffle of the invention.

FIG. 5 discloses still another embodiment of the flow distribution baffle 1 of the invention. In this embodiment, modified "T" shaped bars 95*a*, 95*b* are aligned in confronting relationship with one another as illustrated. Each of these modified "T" shaped bars 95*a*, 95*b* includes a flat central portion 97 and a crowning flange 99 formed in the manner illustrated. Additionally, the flat central portions 97 of each of the modified "T" shaped bars 95*a*, 95*b* includes slots 101*a*, 101*b* which are complementary to, and interlockable with, slots 103*a*, 103*b* formed in an array of locking bars 105*a*, 105*b*. When the modified "T" shaped bars 95*a*, 95*b* are interconnected by means of the locking bars 105*a*, 105*b* in the manner indicated in FIG. 5, the flat central portions 97 of the modified "T" shaped bars 95*a*, 95*b* and the sides of the locking bars 105 form an array of square, tube-capturing cells 106. Additionally, a current-blocking annular flange 107 is formed around the edge of each of the square cells 106 from the alignment of the semicircular recesses 109 present along the crowning flanges 99 of each of the modified "T" shaped bars 95*a*, 95*b*. As was the case with the embodiment illustrated in FIGS. 3A–3D, each of these semicircular recesses 109 includes a proximal flat portion 108, and two distal flat portions 111*a*, 111*b* at either of its ends. Flat portion 108 is about 20% of the maximum diameter of the circular opening formed by the alignment of two of the semicircular recesses 109, while flat portions 111*a*, 111*b* are each about 10% of this diameter. The resulting flow distribution baffle 1 operates in precisely the same manner as the baffle 1 described with respect to FIGS. 3A–3D.

While each of the three embodiments provides a flow distribution baffle having all the structural and operational advantages of the invention, the embodiment illustrated in FIGS. 3A–3D is the most preferred, since the fabrication of this particular embodiment requires only 90° bends in the grid members. By contrast, the "T" shaped bars 70, 71 and modified "T" shaped bars 95*a*, 95*b* which form most of the baffle 1 illustrated in FIGS. 4A, 4B and 5 each require at least one 180° bend in the sheet metal from which they are fabricated, which subjects the sheet metal to a greater degree of stress. All of the preferred embodiments are preferably formed from a corrosionresistant, easy-to-machine metal, such as number 405 (or number 347) stainless steel.

I claim as my invention:

1. An improved, grid-type flow distribution baffle for both supporting an array of substantially parallel heat exchange tubes inside a heat exchanger, and for diverting a flow of heat-exchanging fluid from a parallel to a transverse direction with respect to the longitudinal axes of the tubes, comprising:

(a) a plurality of grid members for providing an array of tube-capturing, flat walled cells, wherein each cell has between three and seven flat sides arranged in the shape of a regular polygon, and wherein each wall is closely adjacent and substantially parallel to the outer surface of its respective tube for supporting said tube by line contact with one or more walls, and (b) a fluid flow diverting means connected around one of the edges of each cell which at least partially circumscribes the tube in the cell, but does not come into contact with it.

2. The improved, grid-type flow distribution baffle of claim 1, wherein said cell has between three and five sides.

3. The improved, grid-type flow distribution baffle of claim 1, wherein each cell has four sides.

4. The improved, grid-type flow distribution baffle of claim 1, wherein said grid members are interlocking.

5. The improved, grid-type flow distribution baffle of claim 1, wherein said fluid flow resisting means is a flange.

6. The improved, grid-type flow distribution baffle of claim 5, wherein said flange completely circumscribes each of said tubes in said cells.

7. An improved, grid-type flow distribution baffle for both supporting an array of substantially parallel heat exchange tubes inside a heat exchanger, and for diverting a flow of heatexchanging fluid flowing inside the heat exchanger from a parallel to a transverse direction with respect to the longitudinal axes of the tubes, comprising:

(a) a plurality of interlocking grid members including a parallel set of "Z" shaped bars having a central flat strip portion, and orthogonally disposed flanges along each side which point in opposite directions, and a set of flat, parallel bars that interlock with the parallel array of "Z" shaped bars for providing an array of parallel, tube-capturing, flat-walled cells which are registrable with the array of heat exchange tubes inside the heat exchanger, wherein each cell has four walls, and wherein each wall is closely adjacent and substantially parallel to the outer surface of its respective tube, and (b) a flange disposed at one end of each of said cells in the corners thereof, but not in contact with said tube for resisting the flow of heat-exchanging fluid through said cell.

8. The improved, grid-type flow distribution baffle of claim 7, wherein each of said orthogonally disposed flanges includes a set of semicircular recesses equidistantly disposed along its edge, and wherein said set of flat, parallel bars locks together the "Z" shaped bars with their side flanges adjacent one another and the semicircular recesses in registry with one another, whereby each of the four-sided cells defined by the interlocking "Z" shaped and flat bars forms said fluid flow resisting flange with an annular edge which circumscribes but does not come into contact with its respective tube.

9. The improved, grid-type flow distribution baffle of claim 7, wherein said flange substantially circumscribes, but does not come into contact with, said tube.

10. The improved, grid-type flow distribution baffle of claim 9, wherein each cell is square-shaped.

11. An improved, grid-type flow distribution baffle for use in a steam generator having a tubesheet for both laterally securing a plurality of vertically oriented heat exchange tubes which are mounted on, and which extend above, said tubesheet, and for diverting a flow of heat-absorbing water flowing within said steam generator from a generally vertical to a substantially lateral direction across the tubes in order to maintain a sludge-removing flow of water across said tubesheet, comprising:

(a) a plurality of interlocking grid members that includes a parallel set of "Z" shaped bars having a central flat strip portion, and orthogonally disposed flanges along each side which point in opposite directions, and a set of flat, parallel bars which interlock with the parallel array of "Z" shaped bars to form an array of four-sided, tube-capturing cells for providing an array of parallel, tube-capturing, square cells which are registrable with the array of vertically oriented heat exchange tubes, wherein each wall of each of said square cells is closely adjacent the outer surface of its respective tube, and wherein at least one wall contacts said tube substantially along the entire vertical length of the wall, and (b) a flange connected along one edge of each cell, wherein said flange substantially circumscribes but does not contact said tube, for diverting the flow of heat-absorbing water through the cells from a vertically oriented flow to a lateral flow across the tubesheet of the steam generator.

12. The improved, grid-type flow distribution baffle of claim 11, wherein each of said orthogonally disposed flanges includes a set of semicircular recesses equidistantly disposed along its edge, and wherein said set of flat, parallel bars locks together the "Z" shaped bars with their side flanges adjacent one another and the semicircular recesses in registry with one another, whereby each of the four-sided cells defined by the interlocking "Z" shaped and flat bars forms a fluid flow resisting flange with an annular edge which circumscribes but does not come into contact with its respective tube.

13. An improved, grid-type flow distribution baffle for both supporting an array of substantially parallel heat exchange tubes inside a heat exchanger, and for diverting a flow of heat-exchanging fluid flowing inside the heat exchanger from a parallel to a transverse direction with respect to the longitudinal axes of the tubes, comprising:

(a) a plurality of interlocking grid members including two sets of substantially flat, equidistantly parallel grid bars which mutually interlock to form an array of parallel, tube-capturing, flat-walled cells which are square and registrable with the array of heat exchange tubes inside the heat exchanger, wherein each cell wall is closely adjacent and substantially parallel to the outer surface of its respective tube, and (b) a flange disposed at one end of each of said cells in the corners thereof, but not in contact with said tube, for resisting the flow of heatexchanging fluid through said cell.

14. The improved, grid-type flow distribution baffle of claim 13, wherein each side of said "T" shaped flange of each bar includes a plurality of equidistantly spaced, quarter-circular recesses which are mutually registrable with one another when said two sets of equidistantly parallel grid bars are mutually interlocked, whereby each of the resulting square, tube-capturing cells forms a fluid flow resisting flange which circumscribes, but does not come into contact with, its respective tube.

15. An improved, grid-type flow distribution baffle for both supporting an array of substantially parallel heat exchange tubes inside a heat exchanger, and for diverting a flow of heat-exchanging fluid flowing inside the heat exchanger from a parallel to a transverse direction with respect to the longitudinal axes of the tubes, comprising:

(a) a plurality of interlocking grid members including two sets of substantially flat, equidistantly parallel grid bars which mutually interlock, wherein each of the said bars of one of the two sets includes a "T" shaped flange along one of its sides for providing an array of parallel, tube-capturing, flat-walled cells which are registrable with the array of heat exchange tubes inside the heat exchanger, wherein each cell is square, and wherein each cell wall is closely adjacent and substantially parallel to the outer surface of its respective tube, and (b) a fluid flow resisting flange disposed at one end of each of said cells in the corners thereof, but not in contact with said tube, for resisting the flow of heat-exchanging fluid through said cell.

16. The improved, grid-type flow distribution baffle of claim 15, wherein each side of said "T" shaped flange of each of said bars includes a plurality of equidistantly spaced, semicircular recesses which are mutually registrable with one another when said two sets of equidistantly parallel grid bars are mutually interlocked, whereby each of the resulting square, tube-capturing cells forms a fluid flow resisting flange which circumscribes, but does not come into contact with, its respective tube.

17. An improved, grid-type flow distribution baffle for both supporting an array of substantially parallel heat exchange tubes inside a heat exchanger, and for diverting a flow of heat-exchanging fluid from a parallel to a transverse direction with respect to the longitudinal axes of the tubes, comprising:

(a) a plurality of grid members including a parallel set of "Z" shaped bars having a central flat strip portion, and orthogonally disposed flanges along each side that point in opposite directions, and a set of flat, parallel bars which interlock with the parallel array of "Z" shaped bars for providing an array of tube-capturing, four-sided, flat walled cells, wherein each wall is closely adjacent and substantially parallel to the outer surface of its respective tube, and (b) a fluid flow resisting means connected around one of the edges of each cell which at least partially circumscribes the tube in the cell, but does not come into contact with it.

18. The improved, grid-type flow distribution baffle of claim 17, wherein each of said orthogonally disposed flanges includes a set of semicircular recesses equidistantly disposed along its edge, and wherein said set of flat, parallel bars locks together the "Z" shaped bars with their side flanges adjacent one another and the semicircular recesses in registry with one another, whereby each of the four-sided cells defined by the interlocking "Z" shaped and flat bars forms a fluid flow resisting flange with an annular edge which circumscribes but does not come into contact with its respective tube.

19. An improved, grid-type flow distribution baffle for both supporting an array of substantially parallel heat exchange tubes inside a heat exchanger, and for diverting a flow of heat-exchanging fluid from a parallel to a transverse direction with respect to the longitudinal axes of the tubes, comprising:

(a) a plurality of grid members including two sets of substantially flat, equidistantly parallel grid bars that mutually interlock, wherein each bar includes a "T" shaped flange along one of its sides for providing an array of tube-capturing, four-sided, flat walled cells, wherein each wall is closely adjacent and substantially parallel to the outer surface of its respective tube, and (b) a fluid flow resisting means connected around one of the edges of each cell which at least partially circumscribes the tube in the cell, but does not come into contact with it.

20. The improved, grid-type flow distribution baffle of claim 19, wherein each side of said "T" shaped flange of each bar includes a plurality of equidistantly spaced, quarter-circular recesses which are mutually registrable with one another when said two sets of equidistantly parallel grid bars are mutually interlocked, whereby each of the resulting square, tube-capturing cells includes a fluid flow resisting flange which circumscribes, but does not come into contact with, its respective tube.

21. An improved, grid-type flow distribution baffle for both supporting an array of substantially parallel heat exchange tubes inside a heat exchanger, and for diverting a flow of heat-exchanging fluid from a parallel to a transverse direction with respect to the longitudinal axes of the tubes, comprising:

(a) a plurality of grid members including two sets of substantially flat, equidistantly parallel grid bars that mutually interlock, wherein each of the grid bars of one of the two sets includes a "T" shaped flange along one of its sides for providing an array of square, tube-capturing, flat walled cells, wherein each cell wall is closely adjacent and substantially parallel to the outer surface of its respective tube, and (b) a fluid flow resisting means connected around one of the edges of each cell which at least partially circumscribes the tube in the cell, but does not come into contact with it.

22. The improved, grid-type flow distribution baffle of claim 21, wherein each side of said "T" shaped flange of each of said bars includes a plurality of equidistantly spaced, semicircular recesses which are mutually registrable with one another when said two sets of equidistantly parallel grid bars are mutually interlocked, whereby each of the resulting square, tube-capturing cells includes a fluid flow resisting flange which circumscribes, but does not come into contact with, its respective tube.

* * * * *